US007997413B2

(12) United States Patent
Schmitz et al.

(10) Patent No.: US 7,997,413 B2
(45) Date of Patent: Aug. 16, 2011

(54) APPARATUS IN SPINNING PREPARATION FOR SEPARATING FOREIGN OBJECTS AT CONVEYING EQUIPMENT FOR FIBRE MATERIAL

(75) Inventors: Joerg Schmitz, Linnich (DE); Konrad Temburg, Moenchengladbach (DE)

(73) Assignee: Truetzschler GmbH & Co. KG, Moenchenglahbach (DE)

( * ) Notice: Subject to any disclaimer, the term of this patent is extended or adjusted under 35 U.S.C. 154(b) by 688 days.

(21) Appl. No.: 12/010,270

(22) Filed: Jan. 23, 2008

(65) Prior Publication Data

US 2008/0178432 A1 Jul. 31, 2008

(30) Foreign Application Priority Data

Jan. 26, 2007 (DE) ..... 10 2007 005 049

(51) Int. Cl.
*B05B 1/00* (2006.01)
*B07C 5/00* (2006.01)

(52) U.S. Cl. ..... 209/44.2; 209/576; 209/644; 239/556; 239/562

(58) Field of Classification Search ..... 209/44.2, 209/576, 639, 644, 932; 239/556, 562
See application file for complete search history.

(56) References Cited

U.S. PATENT DOCUMENTS

| | | | | |
|---|---|---|---|---|
| 177,174 | A * | 5/1876 | Tolles | 209/458 |
| 4,153,978 | A * | 5/1979 | Bangert | 19/304 |
| 4,962,638 | A | 10/1990 | Lane | |
| 5,339,965 | A * | 8/1994 | Klukis et al. | 209/639 |
| 5,350,118 | A * | 9/1994 | Mitchell et al. | 239/551 |
| 5,791,489 | A | 8/1998 | Leifeld | |
| 5,819,373 | A * | 10/1998 | Schlichter et al. | 19/205 |
| 6,202,259 | B1 | 3/2001 | Burr et al. | |
| 6,249,935 | B1 * | 6/2001 | Leifeld | 19/204 |
| 6,260,712 | B1 * | 7/2001 | Flottmann et al. | 209/639 |
| 6,298,522 | B1 | 10/2001 | Rubenach | |
| 7,143,479 | B2 * | 12/2006 | Hosel et al. | 19/98 |
| 2008/0178431 | A1 * | 7/2008 | Schmitz et al. | 19/106 R |

FOREIGN PATENT DOCUMENTS

| | | |
|---|---|---|
| DE | 296 04 552 U1 | 7/1996 |
| DE | 196 45 844 A1 | 5/1998 |
| DE | 198 06 891 A1 | 8/1999 |

(Continued)

OTHER PUBLICATIONS

German Search Report dated Aug. 17, 2007, issued in Application No. 10 2007 005 049.8.

(Continued)

*Primary Examiner* — Joseph C Rodriguez
(74) *Attorney, Agent, or Firm* — Venable LLP; Robert Kinberg; Leigh D. Thelen

(57) ABSTRACT

In an apparatus in spinning preparation for separating foreign objects at conveying equipment for fiber material, at least one separation device is associated with the conveying equipment. The separation device comprises an arrangement for producing a blast of air that flows in the direction onto the conveying equipment and generates an air flow that detaches the foreign objects from the conveyed fibers and carries them away. The arrangement comprises a plurality of blast nozzles arranged across the width of the conveying equipment and connected to a compressed air pipe and to valves. To reduce the proportion of good fibers in the waste in a simple manner, and to allow a more selective action of the blast air current, a bar member for mounting the blast nozzles is present and the nozzles are integrated in the bar member.

20 Claims, 6 Drawing Sheets

FOREIGN PATENT DOCUMENTS

| | | | | |
|---|---|---|---|---|
| DE | 198 47 237 | A1 | | 8/1999 |
| DE | 100 22 734 | A1 | | 11/2001 |
| DE | 699 12 110 | T2 | | 7/2004 |
| DE | 10 2005 005 463 | A1 | | 8/2006 |
| EP | 41863 | A2 | * | 12/1981 |
| EP | 1 354 988 | A1 | | 10/2003 |
| GB | 2 334 534 | A | | 8/1999 |
| KR | 2003-0039355 | A | | 4/2003 |
| WO | WO 89/ 01832 | | | 3/1989 |
| WO | WO 2006/079426 | A1 | | 8/2006 |

OTHER PUBLICATIONS

UK Intellectual Property Office Search Report, dated Apr. 1, 2008, issued in connection with counterpart British Application No. 0801332.8.

German Search Report dated Jan. 26, 2007, issued in related application No. DE 102007005047.1.

UK Intellectual Property Office Search Report, dated Apr. 2, 2008, issued in connection with related British Application No. 0801334.4.

* cited by examiner

APPARATUS IN SPINNING PREPARATION FOR SEPARATING FOREIGN OBJECTS AT CONVEYING EQUIPMENT FOR FIBRE MATERIAL

CROSS REFERENCE TO RELATED APPLICATION

This application claims priority from German Patent Application No. 10 2007 005 049.8 dated Jan. 26, 2007, the entire disclosure of which is incorporated herein by reference.

BACKGROUND OF THE INVENTION

The invention relates to an apparatus in spinning preparation for separating foreign objects at conveying equipment for fibre material, for example, cotton, synthetic fibres or the like.

It is known to provide a device for separating the foreign objects associated with the conveying equipment, which device comprises an arrangement for producing a current of blast air that flows in the direction onto the conveying equipment and generates an air stream that detaches the foreign objects from the conveying equipment and carries the foreign objects away, the arrangement comprising a plurality of blast nozzles that are arranged across the width of the conveying equipment and are connected to a compressed air pipe and to valves.

From WO 89/01832 A it is known that a plurality of blast nozzles are arranged across the width at an outer wall of the pneumatic conveyor conduit through which a current of fibre and air flows. The blast nozzles are placed freely side by side on the wall and are spaced relative to one another. Eight blast nozzles are intended to be sufficient for a 160 mm wide conveyor conduit. In order to emit gas bursts, air valves having a response time of 10 msec or less are associated with the blast nozzles. In practice, the nozzles with the valves are fixed to the outer wall of the conveyor conduit. These valves, which are arranged side by side, require a good deal of space. This results in relatively large distances between the blast nozzles, with a consequent considerable dispersion of the blast air jets. The blast air is thus effective over relatively wide areas, which leads to an undesirably high separation of good fibres with the foreign objects.

In the case of a known apparatus (DE-A-196 45 844), two slow-speed feed rolls are associated with an opening roll laterally and horizontally and feed the fibre material to the opening roll. To keep the co-rotating envelope of air on the opening roll, guide plates are provided. At the lower end of the opening roll there is a device (sensors) for optical detection of foreign particles in the fibre tufts, which is located in a collecting area for separated particles. Between the guide plate and a blade there is an opening though which a current of blast air is directed obliquely from below briefly onto that area of the roll surface where the fibre tufts contain unwanted foreign particles. In this way, the contaminated fibre tufts are blown off the roll surface and then carried away. The drawback of this apparatus is the considerable space requirement, which is caused inter alia by the blowing direction of the blast air source (air nozzles) in the area beneath the opening roll. In addition, it is inconvenient that the blast air source and the valves are located freely in the waste collecting area, which leads to considerable interference to operation, interruptions and the like. Another disadvantage is that the air nozzles with the magnetic valves are arranged separately across the width of the roll. The air jet of each individual air nozzle is therefore directed either tangentially, or slightly away from this tangent, away from the opening roll. A consistent quality of separation and a rapid adjustment when the processed fibre material is changed to one with different proportions of foreign objects is not possible with this apparatus. Finally, the air nozzles are in the form of flat fan nozzles, so that with not too large a number of nozzles it is possible to cover the entire width of the roll.

SUMMARY OF THE INVENTION

It is an aim of the invention to produce an apparatus of the kind described initially that avoids or mitigates the said disadvantages and in particular permits in a structurally simple manner a consistent quality of separation, namely, a reduction in the proportion of good fibres in the waste, and allows a more selective action of the blast air current.

The invention provides an apparatus in a spinning preparation installation, having:

conveying equipment for conveying fibre material; and an arrangement for separating foreign objects from said fibre material, having a plurality of air nozzles arranged in a direction across the width of the conveying equipment for directing a blast of air at the fibre material for generating a flow of air that detaches and removes the foreign objects from the conveyed fibre material, the air nozzles being connected to a source of compressed air;

wherein the separation arrangement comprises a bar member into which the air nozzles are incorporated.

Because a bar is provided for mounting the blast nozzles, integration of the blast nozzles is facilitated in a simple way. The blast nozzles can be arranged efficiently, for example, closely side by side in the interior of the blast nozzle bar, thus enabling a considerably higher number of blast nozzles across the width of the conveying equipment to be achieved. In addition, the integration permits an especially simple assembly and disassembly of the blast nozzles, e.g. by insertion and removal respectively (exchange). The bar may be of substantially uniform cross-section, and may advantageously include an inner hollow space within which at least a part of each nozzle can be housed. An inner hollow space of the blast nozzle bar is advantageously used simultaneously as a compressed air duct. Another advantage is that the positions of the nozzles relative to one another can be substantially exact owing to mechanical machining in the blast nozzle bar (support profile). The components, for example, blast nozzles and valves, that are integrated in the blast nozzle bar are not susceptible to dirt deposits. Narrow blast nozzles and valves can be used, which further reduces the space requirement. Through the increased number of blast nozzles across the width and their reduced distance from one another, and since the blast nozzles, selectively activated, are directed onto the foreign objects, a strong focus on the foreign objects and removal thereof is possible, so that the undesirable separation of good fibres is substantially reduced.

The blast nozzle bar is preferably made from an extruded profile, for example, of aluminium, in which the valve inserts are integrated. This therefore enables a plurality of valves, lying side by side close together, to be provided over the width of the conveying equipment and at the same time the storage volume of the blast nozzle bar is increased, for example, doubled. The option of being able to integrate more valves and blast nozzles in the blast nozzle bar substantially reduces the proportion of good fibres in the waste. The apparatus according to the invention provides one or more of the following advantages:

Relatively small installation space, hence improved accessibility

Larger air volume in the blast bar

Integration of more than 32 valves across the width (LGW) of the machine is possible Fewer good fibres in the waste Simpler and quicker servicing possible Not susceptible to dirt deposits Nozzle positions relative to one another accurate due to mechanical machining in the support profile member The provision of a nozzle plate enables a plurality of nozzles to be supplied for blowing out purposes using one valve.

In certain embodiments, it is preferred for multiple, for example, all, of the air nozzles to be connected to a common source of compressed air, for example, to a compressed air pipe. The air nozzles are advantageously associated with valves for controlling the emission of air blasts from the air nozzles. For example, each air nozzle may be associated with a respective valve. In some embodiments, the conveying equipment is a pneumatic conveyor duct. In other embodiments, the conveying equipment is a clothed roll, high-speed roll having a clothed face for opening or doffing fibre material.

In yet further embodiments, the apparatus comprises at least one clothed roll with an associated bar member with air nozzles for removal of foreign objects from fibre on the roll, and at least one pneumatic conveyor duct with a further bar member with air nozzles for removing foreign objects from fibre material in the duct.

Advantageously, the bar is a housing with wall elements. Advantageously, the interior of the housing is hollow. Advantageously, the housing comprises a hollow profile with profile walls. The housing may be produced by non-cutting shaping, for example, by extrusion moulding. The hollow profile may be produced by cutting to length, e.g. severing, a semi-finished extruded part.

It is preferred that the compressed air supply is effected through the interior of the housing. Advantageously, the nozzles pass through the interior and a wall surface of the housing. Advantageously, the valves, which are preferably magnetic valves, are arranged at least partially in the interior of the housing.

Advantageously, the bar member is arranged at a distance from the conveying equipment, e.g. opener roll or doffer roll. Where the conveying equipment is an opener or doffer roll, the longitudinal axis of the bar member is advantageously arranged axially parallel to the opening roll or doffer roll. Advantageously, the longitudinal axis of the bar member extends parallel to the clothed face of the opening roll or doffer roll.

Where the conveying equipment is a duct, the longitudinal axis of the bar member advantageously extends transversely to the axis of the pneumatic transport duct (conveying direction).

Advantageously, the blast air current is an air jet. The blast air current may be directed substantially tangentially to the surface of the clothed roll. Instead, the blast air current may be directed at least partially onto the clothed face. Advantageously, the effective direction of the blast air current is adjustable in relation to the clothed roll.

Advantageously, the bar member with the nozzle is rotatable or pivotable about a pivot point. Advantageously, the bar with the nozzles is rotatable or pivotable about its longitudinal axis. In certain embodiments, a driven eccentric or the like is provided for the rotary or pivoting movement.

Advantageously, the bar member with the nozzles is radially displaceable, e.g. slidable in relation to the clothed roll. Advantageously, the bar with the nozzles is displaceable, e.g. slidable, axially parallel in relation to the clothed roll. Advantageously, an adjusting device is associated with the device for local displacement.

Where the conveying equipment is a pneumatic conveyor duct, the blast air current may be directed substantially perpendicularly to the axis of the pneumatic transport duct (conveying direction), or at an angle (obliquely) to the axis of the pneumatic transport duct (conveying direction).

Advantageously, openings for the passage of blast air currents are provided in a wall element of the housing. Advantageously, the housing (extruded profile) has continuous bores for receiving the blast nozzles (nozzle inserts). Advantageously, the blast nozzles (nozzle inserts) are insertable through the bores. Advantageously, the blast nozzles (nozzle inserts) are fixed in the housing (extruded profile), for example, a clamping element, e.g. clamping ring or the like, may be used to fix the blast nozzles. Advantageously, the nozzle inserts are narrower than the bores and the narrow blast nozzles are insertable through the bores.

In certain preferred embodiments, the inner hollow space of the housing (extruded profile) is a compressed air duct. Advantageously, the inner hollow space of the housing (extruded profile) has a circular cross section. Advantageously, the housing (extruded profile) has a cylindrical inner hollow space. Advantageously, two rows of bores arranged side by side are provided axially parallel to the longitudinal axis of the housing (extruded profile). In some embodiments, the valve control means for the valves are arranged outside the inner hollow space. Advantageously, the valves penetrate at least partially a wall surface of the housing.

In some embodiments, the electrical leads for the valve control means are integrated in the housing (extruded profile). Advantageously, the bores in the wall surface of the housing (extruded profile) that are remote from the valves are used as nozzles. Advantageously, the bores in the wall surface of the housing that are remote from the valves are open towards the atmosphere. Advantageously, the air inlet openings for the nozzle inserts are arranged in the inner hollow space, which as indicated above may serve as a compressed air duct. Advantageously, the bores in the wall surface of the housing are remote from the valves, and the valve inserts, are hermetically sealed with respect to one another. Advantageously, the bores in the wall surface of the housing arranged in the region of the valves, and the valve housing, are hermetically sealed with respect to one another.

By way of illustration, in the case of a clothed roll more than 32 valves may be provided across the width, e.g. 1600 mm. The clothed roll may be of a different width, with a greater or smaller number of valves. In certain embodiments, as is further described below, the number of air nozzle outlets may be greater than the number of valves and associated nozzle inserts. Thus, for example, a nozzle plate or the like having a plurality of apertures, e.g. two to three times the number of nozzle bores, may be associated with the outlet of the nozzle bores (outlet bores).

In certain preferred embodiments, an optical sensor system is arranged upstream of the separating device. For example, an optical sensor system for the detection of foreign objects, e.g. foreign fibres, trash and the like, may be associated with an opening roll or doffer roll. Instead, or as well, an optical sensor system for the detection of foreign objects of polypropylene, e.g. polypropylene bands, fabric and sheeting, in or between fibre tufts, for example, of cotton and/or synthetic fibres, may be associated with an pneumatic transport duct. In an especially preferred embodiment, foreign fibres, trash and the like are detected on, and removed from, a clothed roller and foreign objects of plastics material are detected or removed in a duct upstream or downstream of the roller. Advantageously, the sensor system is connected via an electronic control and regulating device to the downstream device for the separation of the foreign objects. Advantageously, the magnetic valves are connected to the electronic control and regulating means. The apparatus of the invention provides for the foreign objects to be selectively blown out.

It is preferred that the nozzles are activatable at locations across the width of the conveying equipment corresponding to those upstream locations at which the sensor system has detected foreign objects. Advantageously, a momentary blast air current is activatable. Advantageously, the outlet of all blast nozzles is locally displaceable. Advantageously, the outlet of all blast nozzles is simultaneously displaceable. Advantageously, the outlet of the blast nozzles is uniformly displaceable. Advantageously, the outlet of the blast nozzles is displaceable by the same amount. Advantageously, the nozzle inserts penetrate the inner hollow space of the housing (extruded profile). Advantageously, the inner hollow space of the housing (extruded profile) is hermetically sealed with respect to the atmosphere.

The invention also provides an apparatus in spinning preparation for separating foreign objects at conveying equipment for fibre material, for example, cotton, synthetic fibres or the like, in which at least one device for separating the foreign objects is associated with the conveying equipment, which device comprises an arrangement for producing a current of blast air that flows in the direction onto the conveying equipment and generates an air flow that detaches the foreign objects from the conveying equipment and carries the foreign objects away, wherein the arrangement comprises a plurality of blast nozzles that are arranged across the width of the conveying equipment and are connected to a compressed air pipe and to valves, characterised in that a bar for mounting the blast nozzles is present and the blast nozzle are integrated in the bar.

DETAILED DESCRIPTION OF CERTAIN PREFERRED EMBODIMENTS

Figure 1:
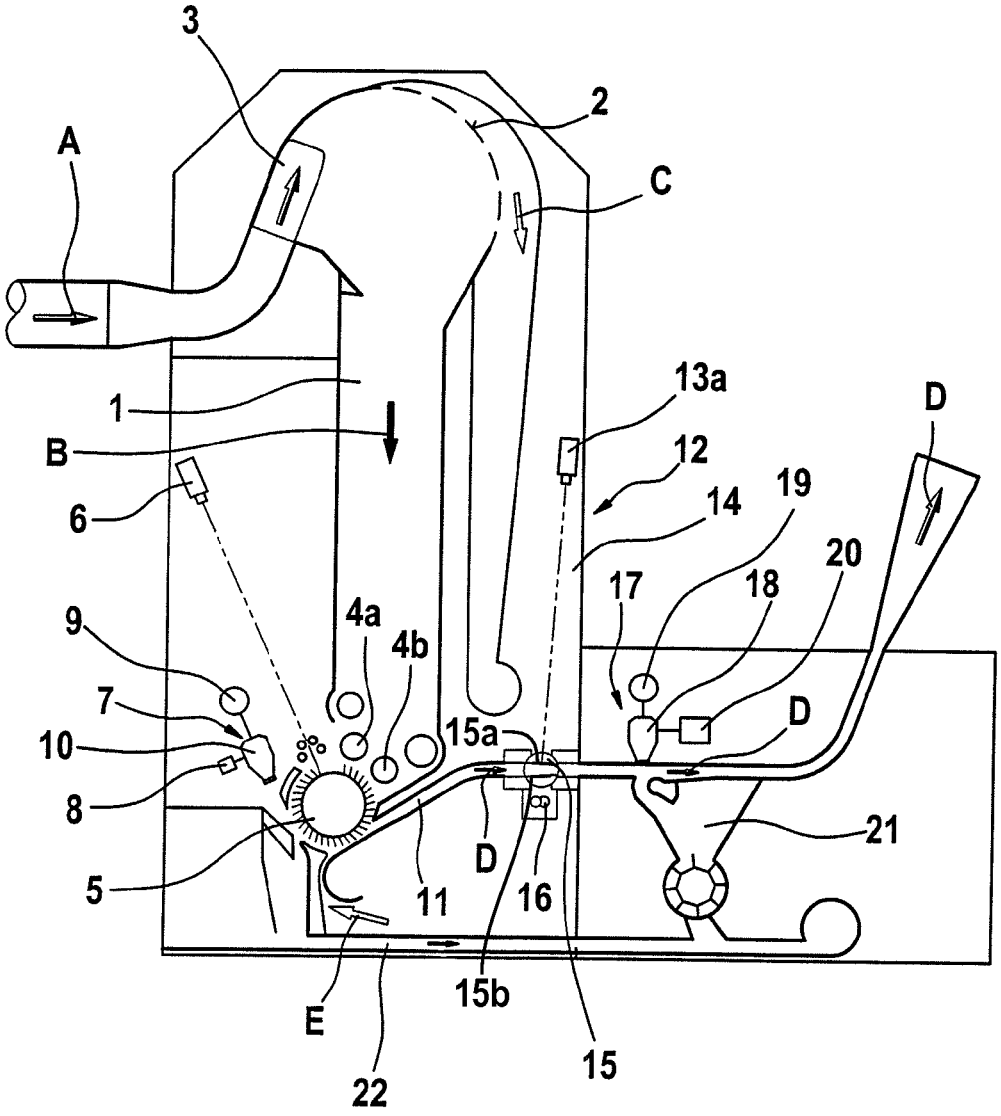
FIG. 1 is a schematic side view of a foreign particle detection and separation device, having two arrangements of the apparatus according to the invention.

Referring to FIG. 1, in an apparatus for detecting and separating foreign objects, e.g. the foreign part separator SECUROMAT SP-F2, made by Trützschler GmbH & Co. K.G. of Mönchengladbach, Germany, the upper inlet opening of a feed chute 1 has associated with it an arrangement for the pneumatic supply of a fibre-air flow A, which comprises a fibre material transport fan (not shown), a stationary air-permeable surface 2 for separation (ejection) of the fibre material B from air C with air extraction, and an air flow guide means 3 with movable elements; the fibre material present in the air flow is guided reversibly forwards and backwards transversely over the air-permeable surface 2 and, following impact, the fibre material falls substantially as a result of gravity from the air-permeable surface 2 and enters the feed chute 1 downwards. The slow-speed rolls 4*a*, 4*b* have a dual function: they serve as take-off rolls for removing the fibre material B out of the feed chute 1 and at the same time as feed rolls for supplying the fibre material B to a high-speed opening roll 5. The opening roll 5 in the example is in the form of a needle roll. A pin or clothed roll (not illustrated) can also be used as the opening roll. The solid arrows represent fibre material, the empty arrows represent air and the half-filled arrows represent an air current with fibres.

An optical sensor system 6, for example, a line-scan camera 6 (CCD camera) with an electronic evaluating device for the detection of foreign objects, especially with brightness and/or colour variations, is associated with the whole width of the surface area of the opening roll 5. The sensor system 6 is connected by way of an electronic control and regulating device 53 (see FIG. 7) to an arrangement 7 for separating the foreign objects 52 (see FIG. 6). The arrangement 7 is capable of generating a short blast air current, which travels towards the clothed face and creates a suction airflow, which detaches the foreign objects together with a few fibres from the clothed face and carries them away into a channel 22.

The optical sensor system 6 with the camera, for example, a colour line-scan camera, is arranged obliquely above the opening roll 5 close to the outer wall of the feed chute 1. This produces a compact, space-saving construction. The colour line-scan camera 6 is directed towards the clothing of the opening roll 5 and is able to detect coloured foreign objects, for example, red fibres, in the fibre material. The camera 6 covers the entire region across the width of the opening roll 5, e.g. 1600 mm. The opening roll 5 rotates anticlockwise in the direction of the curved arrow. Downstream of the optical sensor system 6 in the direction of rotation is the arrangement 10 for producing a blast air current, the nozzles of which are oriented towards the clothed face of the opening roll 5 in such a way that a short, sudden jet of air flows tangentially in relation to the clothed face. The sensor system 6 is connected by way of an evaluating device and the electronic control and regulating device 53 to the arrangement 7, with which there is associated a valve control means 8. When the camera 6 has detected a foreign object in the fibre material on the clothed face on the basis of comparative and desired values, using the valve control means 8 a short air burst is expelled at high speed in relation to the clothing and tears the foreign object together with a few fibres out of the fibre covering on the clothing by a suction air current, and subsequently carries them away through a channel 22 under suction. The reference numeral 9 denotes a compressed air pipe.

A blast air current L flows through a channel 56 approximately tangentially to the opening roll 5, detaches the fibre covering (good fibres) from the clothing and flows away as a fibre-air flow D through a fibre transport conduit 11.

A further apparatus 12 is associated with the pneumatic fibre transport conduit 11. The apparatus 12 is suitable for detecting foreign objects of any kind, for example, pieces of cloth, tapes, string, pieces of sheeting and the like in the fibre material. According to an advantageous construction, the apparatus 12 is used to detect foreign particles of plastics material, such as polypropylene bands, fabric and sheeting and the like in or between fibre tufts, for example, of cotton and/or synthetic fibres.

In the case of the apparatus 12 for detecting foreign objects, the fibre material is transported in an airflow (fibre-air flow D) through the pneumatic fibre transport conduit 11, which is connected to a suction source (not illustrated). As the optical sensor system, two cameras 13*a*, 13*b*, for example, diode array cameras with polarisation filters, are arranged in a housing 14 above the fibre transport conduit 11 across the machine width, which is, for example, 1600 mm. Beneath the cameras 13*a*, 13*b* (only camera 13*a* is shown), the wall surfaces of the fibre transport conduit 11 have two transparent regions in the form of two parallel and opposite glass panes 15*a*, 15*b* (glass windows), which form a glass channel 15. Lighting equipment 16 is provided beneath the fibre transport conduit 11. Downstream of the glass channel 15, a blowing-out device 17 for separation of the foreign objects detected by the apparatus 12 is associated with the fibre transport conduit 11. Downstream of the blowing-out device 17, the fibre-air flow D is sucked through the fibre transport conduit 11 and fed onwards for further processing.

In operation, the camera 13*a* detects the fibre-air flow D through the glass pane 15*a*. Here, the glass pane 15*a* projects into the fibre-air flow D in such a way that the fibre-air flow D meets the glass pane 15*a* and flows along and in pressure-applying contact with the glass pane 15*a*. Through the movement of the fibre-air flow D, on the one hand unwanted deposits on the glass pane 15*a* are largely or completely avoided and, if slight deposits do occur, they are wiped off the inner surface of the glass pane 15*a* by the fibre-air flow D and carried away through the channel 11. The fibre-air flow D has a similar effect on the inner surface of the glass pane 15*b*.

If unwanted foreign objects are detected in the fibre-air flow D by the apparatus 12, the blowing-out device 17 is activated and blows the foreign objects 52 into a suction channel 21. The blowing-out device 17 is arranged downstream of the optical sensor system 12, and its nozzles are oriented towards the inner space of the conveyor pipe 11 such that a short, sudden air jet flows onto the detected foreign particle. The sensor system 12 is connected by way of an evaluating device and the electronic control and regulating device 53 to the device 17, with which there is associated a valve control means 20. When the camera 13 has detected a foreign object in the fibre material on the basis of comparative and desired values, using the valve control means 20 a short air burst is expelled at high speed and blows the foreign object together with a few fibres out of the fibre-air flow D, and subsequently carries them away through a channel 21 under suction. The reference numeral 19 denotes a compressed air pipe.

Figure 2:
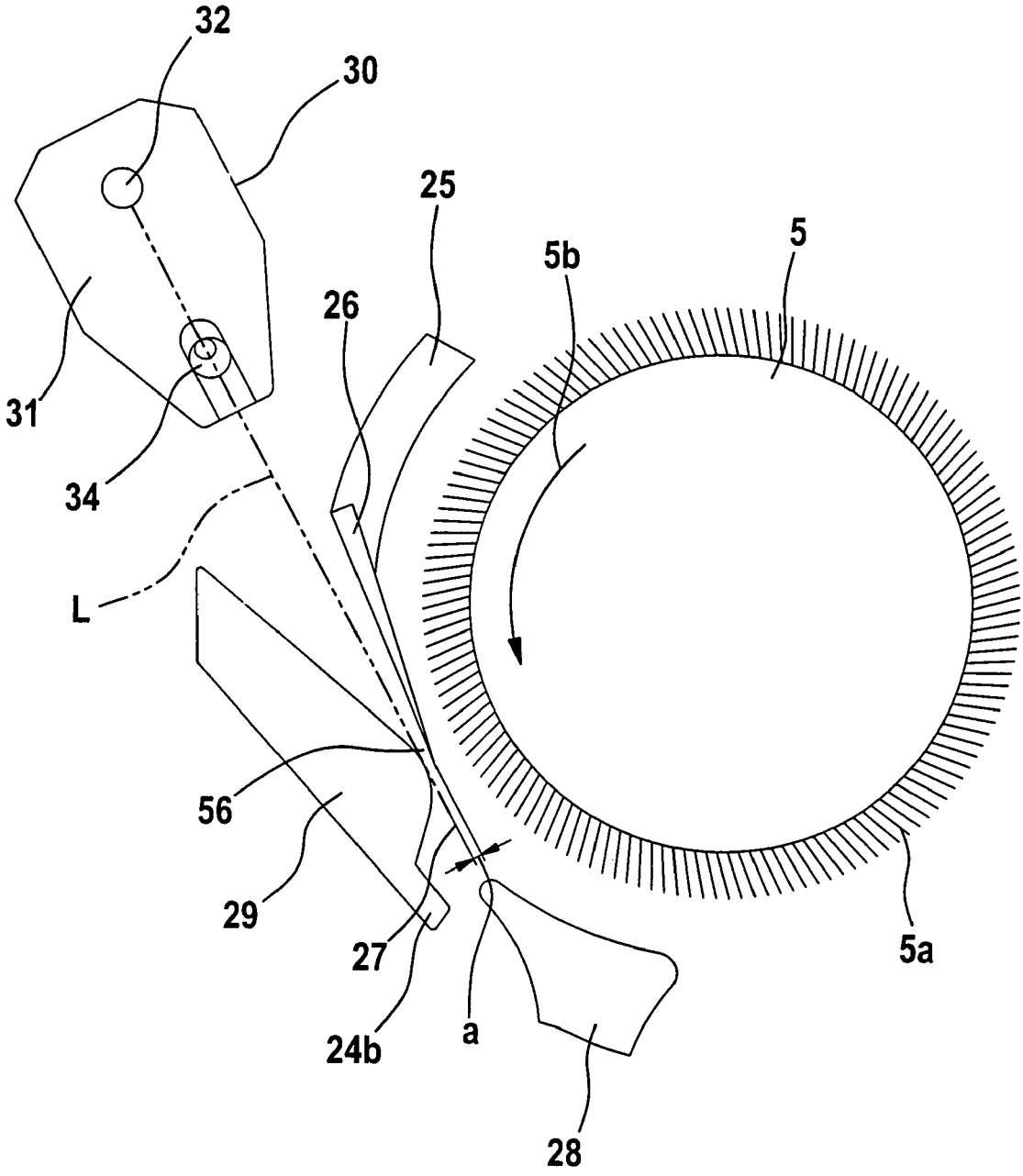
FIG. 2 is a side view of the opening roll of the apparatus of FIG. 1 and associated cover elements and blast nozzle bar.

As shown in FIG. 2, associated with and lying opposite the clothed face 5*a* of the opening roll 5 are, viewed in the direction of rotation 5*b*, a cover 25, a covering air guide element 26, an opening 27 and a cover 28. The air guide element 26 and a guide surface of an opposite guide element 29 are arranged tapering conically towards one another, forming a channel 56, and are spaced a distance a from one another at a constriction, through which the compressed air flow L passes in such a way that it flows a short distance away from the clothed face. This creates a suction air flow in the manner of a water jet pump, which momentarily and locally tears a small amount of fibre together with the foreign objects out of the fibre covering on the clothed face. The guide element 29 has a rounded projection 24*b* and a further guide face, which together with the opposite cover 28 forms a channel through which the air current flows away.

Figure 2A:
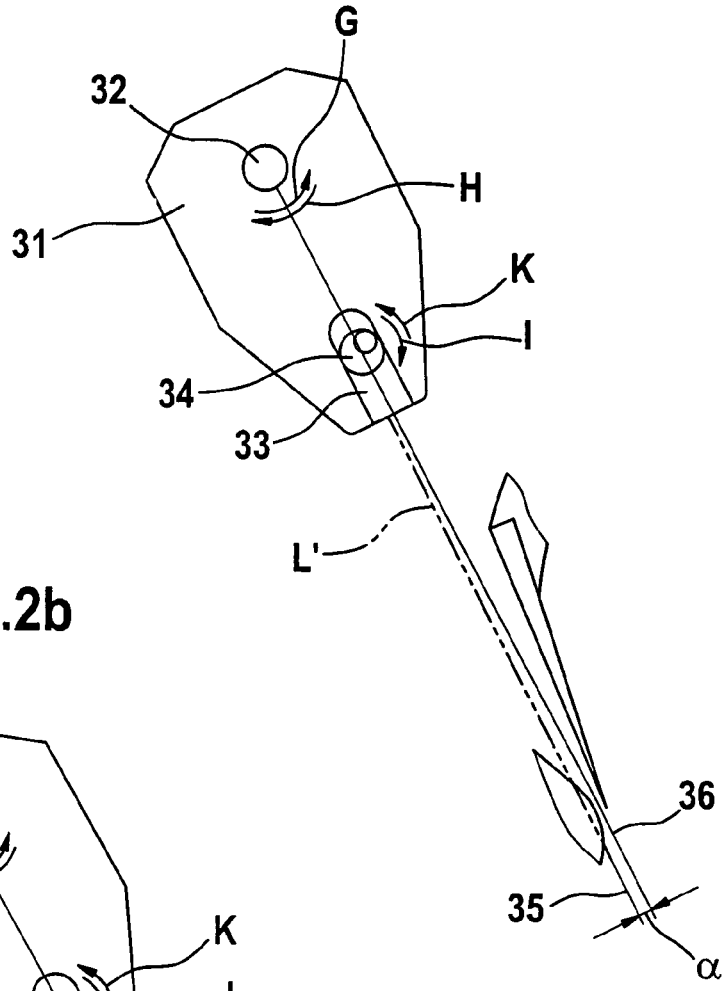
FIGS. 2*a*, 2*b* are side views of a blast nozzle bar with a pivot joint in the inwardly rotated position (FIG. 2*a*) and in the outwardly rotated position (FIG. 2*b*) in relation to the clothed face of the opening roll.
Figure 2B:
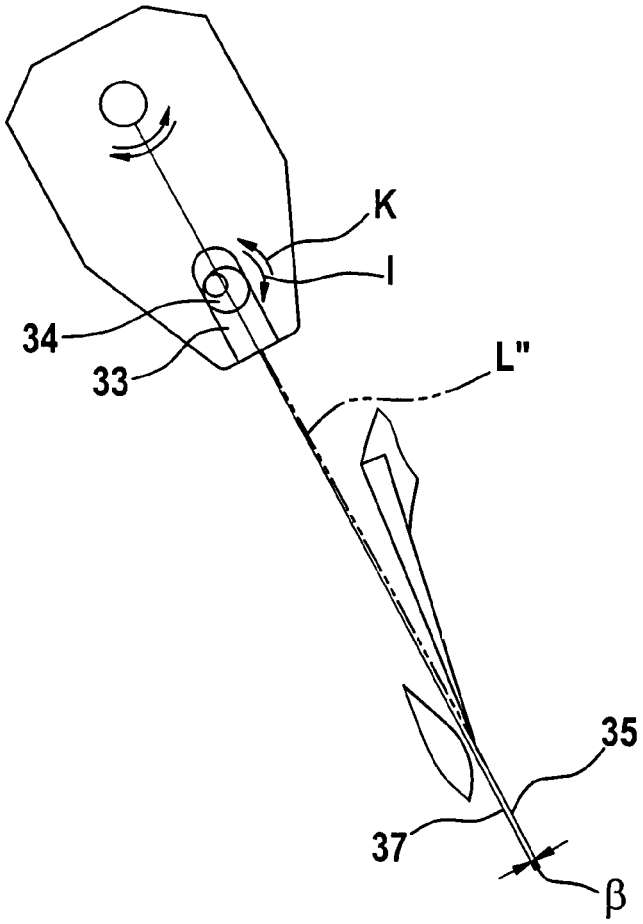

The nozzle bar 30 comprises a housing 31, which is pivotable in and out about a fixed pivot bearing 32 in the direction of the arrows G, H. As shown in FIGS. 2*a* and 2*b*, in its edge region remote from the pivot bearing 32 the housing 31 has an elongate opening 33, within which an eccentric 34 that is rotatable in the direction of the arrows I, K and touches the inner wall surface of the opening 33 is arranged. By rotation of the eccentric 34, the housing 31 is rotated about the pivot bearing 32 so that the outlet 38 of the blast nozzles (see FIG. 5), and hence the direction of the blast air current E in relation to the clothed face 5*a* of the opening roll 5, is locally displaced. Starting from a normal direction 35 denoted by a dot-dash line, the direction 36 of the blast air current L' shown in FIG. 2*a* is moved closer to the clothed face 5*a*; the normal direction 35 and the direction 36 form an acute angle $\alpha$. According to FIG. 2*b*, the direction 37 of the blast air current L" in relation to the normal direction 35 is moved further away from the clothed face 5*a*; the normal direction 35 and the direction 37 form an acute angle $\beta$.

Figure 3:
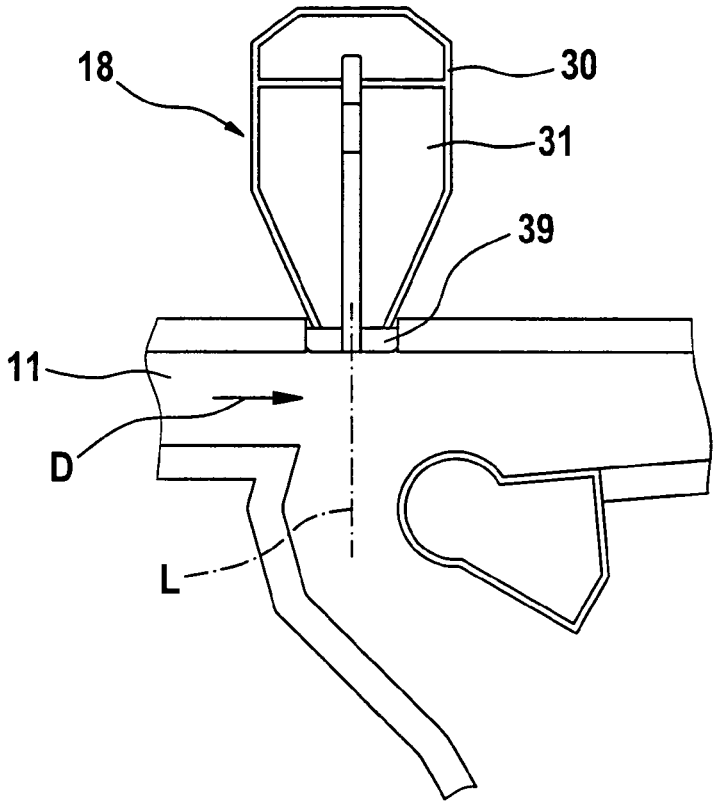
FIG. 3 is a side view of the blast nozzle bar on a fibre tuft feed line.

Corresponding to FIG. 3, the device 18 for generating a blast air current is associated with the pneumatic conveyor conduit 11. In relation to the conveyor conduit 11, the outlet of the housing 31 of the blast nozzle bar 30 is arranged in a continuous wall opening, which extends transversely across the width of the conveyor conduit 11. A nozzle plate 39 is arranged in front of the outlet of the housing 31 with the continuous blast air openings 38 and, as shown in FIG. 4, has a greater number of, for example, about two or three times as many, nozzle openings 40 compared with the number of blast air openings 38.

Figure 4:
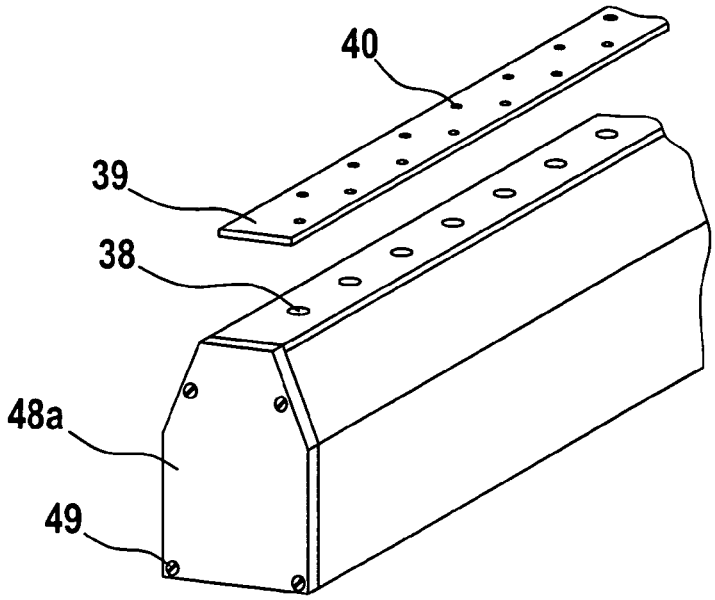
FIG. 4 is a perspective view of the blast nozzle bar with nozzle plate.

FIG. 4 shows one arrangement suitable for use in a nozzle bar according to the invention. The housing 31 is formed in part by a hollow profile. The two open end faces of the hollow profile are closable by a closure plate 48*a* and 48*b* respectively. For that purpose, screws 49 (only one screw is indicated) are provided, which engage right through bores in the closure plates 48*a*, 48*b* into threaded bores provided on the end faces of the hollow profile 31 in the profile walls 31*b*. The closure plates 48*a*, 48*b* consist of aluminium in an exemplary embodiment. The closure plates 48*a*, 48*b* must be secured with firm contact pressure to the hollow profile 31 to ensure an airtight seal of the blast air channel (hollow space 31*a*). A through opening 50 (bore) is provided in the closure plate 48*b*, to which a compressed air pipe 51 (see FIG. 6) leading to a source of compressed air (not illustrated) is connected.

Figure 5:
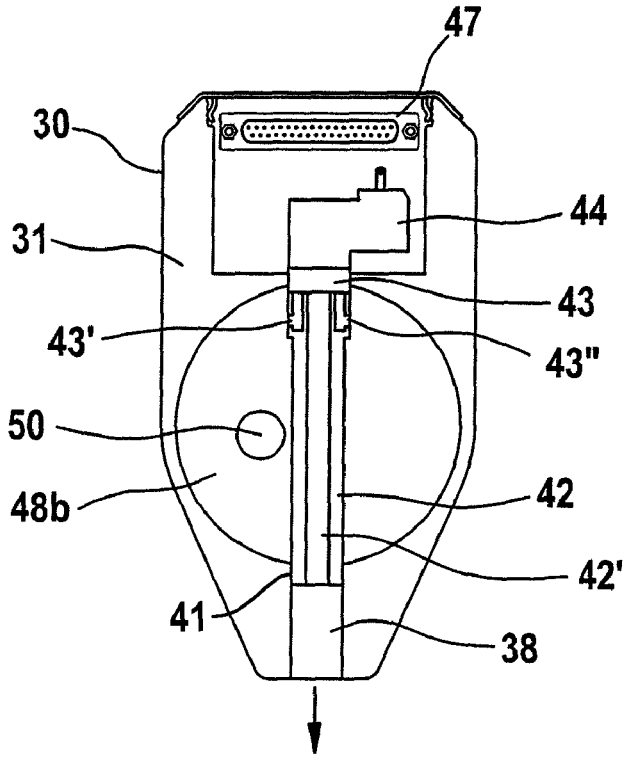
FIG. 5 is a schematic cross-section through the blast nozzle bar with nozzle insert, magnetic valve and magnetic valve control means.
Figure 5A:
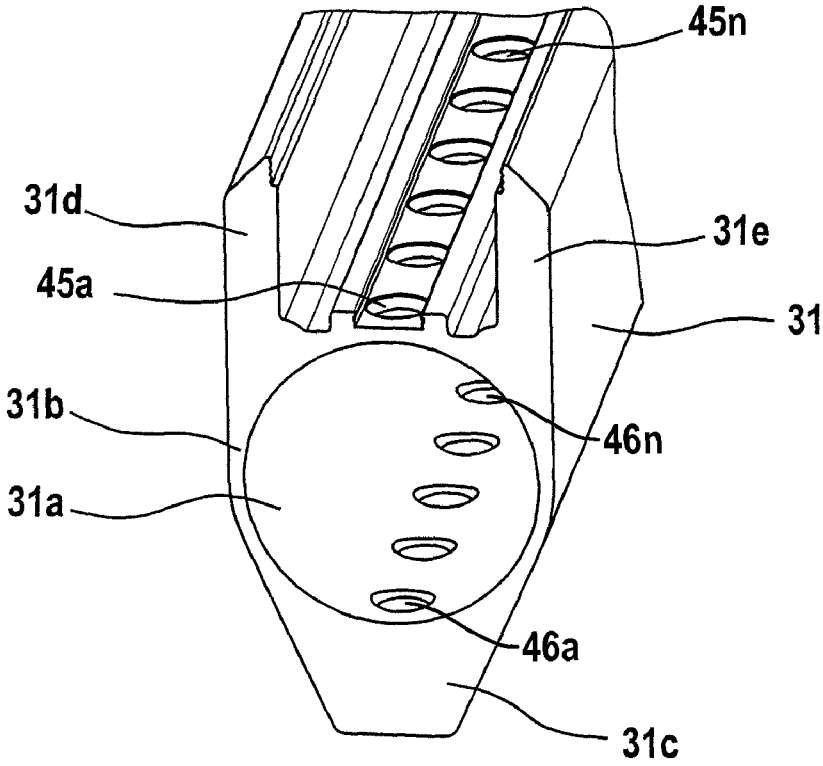
FIG. 5*a* is a perspective view of part of the blast nozzle bar for mounting the blast nozzles.

In a preferred embodiment shown in FIG. 5, the blast nozzle bar 30 comprises a housing 31 in which a plurality of blast nozzles 41 is integrated. The housing 31 shown in FIG. 5*a* is in the form of an extruded hollow profile, e.g. of an Al—Mg alloy, which encloses a closed hollow space 31*a* that serves as a compressed air duct for the blast nozzles 41. The inner space of the hollow space 31*a* has a circular cross-sectional shape. The hollow profile is produced by cutting, e.g. sawing, laser cutting, a length from a semi-finished, extruded hollow profile (not illustrated). The hollow profile in the exemplary embodiment is in one piece. The profile wall is denoted by the reference numeral 31*b* and has different wall thicknesses. Looking at the cross-section shown in FIGS. 5 and 5*a*, the profile wall 31*b* in the region below the hollow space 31*a* is in the form of a neck 31*c* that extends over the entire length, and in the region laterally above the hollow space 31*a* two parallel opposing rails 31*d*, 31*e* are provided, which likewise extend over the entire length. Vertically above the elongate centre line of the hollow space 31*a*, a plurality of through bores 45*a* to 45*n* is provided parallel to the centre line and closely side by side, their number corresponding to the number of blast nozzles 41, e.g. 64 blast nozzles. A plurality of through bores 46*a* to 46*n*, the number of which likewise corresponds to the number of blast nozzles 41, are arranged closely side by side in the profile wall 31*b* and in the neck 31*c* vertically below the elongate centre line. The two rows of bores 45*a* to 45*n* and 46*a* to 46*n* are aligned parallel to one another. The centre lines of the opposing bores 45*a* to 45*n* and 46*a* to 46*n* are aligned with one another, i.e. the opposing bores 45*a* to 45*n* and 46*a* to 46*n* are arranged coaxial to one another.

In the embodiment of FIG. 5, the blast nozzles 41 each comprise a nozzle insert 42, a magnetic valve 43 and a magnetic valve control means 44. Each valve insert 42 with a magnetic valve 43 is pushed through two coaxially opposite bores 45*a* to 45*n* and 46*a* to 46*n* such that the nozzle insert 42 open at one end engages in a bore 46*a* to 46*n* of the neck 31*c*, and the magnetic valve 43 at the other end of the nozzle insert 42 engages through a bore 45*a* to 45*n* in the profile wall 31*b*. Here, one part of the magnetic valve 43, which is arranged in the hollow space 31*a* and projects inwards beyond the profile wall 31*b*, has two inlet openings 43', 43" for blast air (compressed air). A respective magnetic valve control means 44 is mounted at the other region of the magnetic valve 43, which is arranged outside the hollow space 31*a* in the profile wall 31*b*. The magnetic valve control means 44*a* to 44*n* are arranged between the rails 31*d* and 31*e*. Between the rails 31*d* and 31*e* and above the magnetic valves 43*a* to 43*n* there is an elongate duct 47 for the electrical leads to which the magnetic valve control means 44*a* to 44*n* are connected. The outer walls of the nozzle inserts 42*a* to 42*n* and the valves 43*a* to 43*n* are hermetically sealed against the inner walls of the bores 45*a* to 45*n* and 46*a* to 46*n*. The valve inserts 42 and the magnetic valves 43 are also fixed in position by this measure. The magnetic valves 43*a* to 43*n* are each fixed to the profile wall using a clamping ring. The components that are used to generate a current of blast air (compressed air duct 31*a*, nozzle inserts 42 to 42*n*, magnetic valves 43*a* to 43*n*, magnetic valve control means 44*a* to 44*n*) are integrated in the manner illustrated in the bar 30 and in the housing 31.

Figure 6:
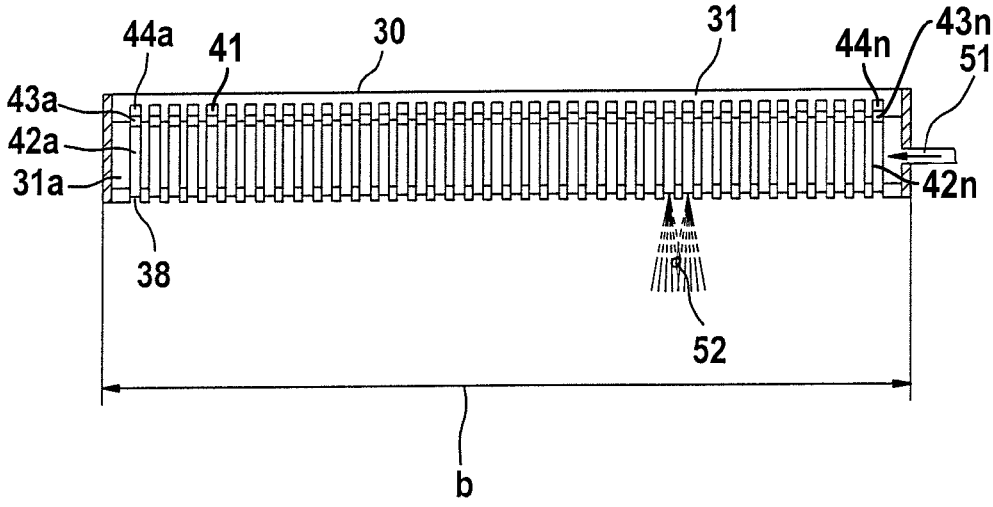
FIG. 6 is a schematic front view in section through the blast nozzle bar.

In a further embodiment shown in FIG. 6, a plurality of blast nozzles 41 arranged side by side across the width b, e.g. 1600 mm, of the conveying equipment is integrated in the blast nozzle bar. The conveying equipment can be an opening roll 5 or a pneumatic conveyor conduit 11. The reference numeral 52 denotes a foreign particle, which is blown out selectively by brief jets of blast air from two adjacent blast air nozzles, and removed. The blast nozzle bar 30 may be as illustrated in, and described with reference to, FIGS. 5 and 5*a*, although any other blast nozzle bar constructed in accordance with the invention may be used.

Figure 7:
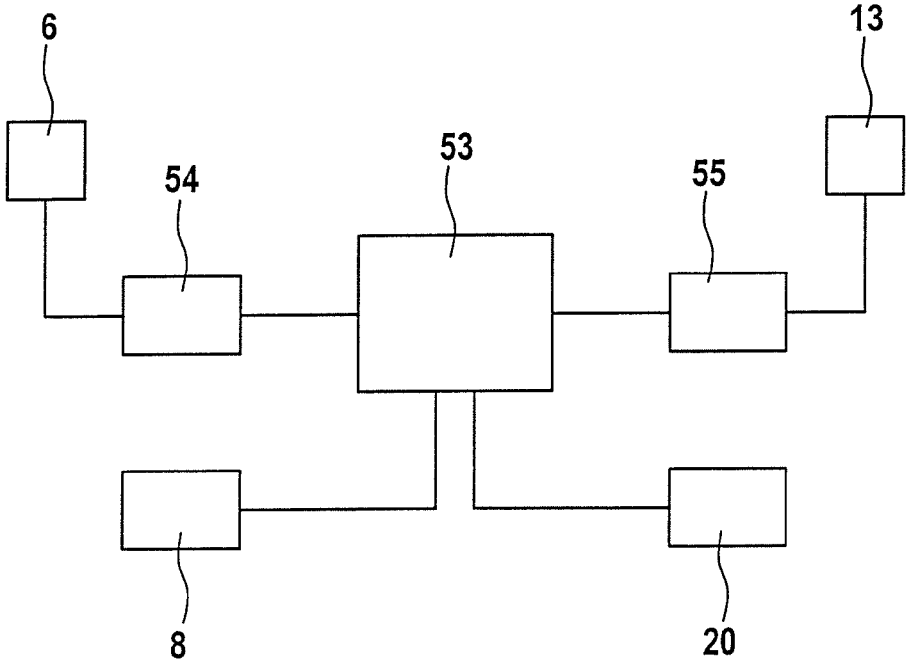
FIG. 7 is a schematic diagram showing an electronic control and regulating device to which two optical sensor systems and two blowing out devices are connected.

In an illustrative control arrangement shown in FIG. 7, the camera 6, an image evaluating device 54 and a valve control means 8 (or that is to say the magnetic control means 44*a* to 44*n*) for the valves of the blowing out device 10 are connected to an electronic control and regulating device 53. In addition, the cameras 13*a*, 13*b*, an image evaluating device 55 and the valve control means 20 (or that is to say the magnetic valve control means 44*a* to 44*n*) for the valves of the blowing out device 18 are connected to the electronic control and regulating device 53.

For ease of reference, a list of the reference numerals used in the accompanying drawings is given in the Table below. Unless otherwise indicated herein, the same reference numerals are used in a number of the Figures to indicate common features, which do not require separate description in relation to each Figure.

TABLE: LIST OF REFERENCE NUMERALS

1 Hopper
2 Air-permeable surface
3 Air current guide means
4*a*, 4*b* Rolls
5 Opening roll
5*a* Clothed face
6 Sensor system
7; 17 Device for separating the foreign objects
8; 20 Valve control
9; 19 Compressed air pipe
10; 18 Arrangement for generating a blast air current
11 Fibre transport duct
12 Device for detecting foreign objects
13*a*, 13*b* Cameras
13 Housing
14 Glass channel
15*a*, 15*b* Glass panes
16 Illuminating means
21 Channel
22 Channel
25 Cover
26 Air guide element
27 Opening
28 Cover
29 Guide element
30 Nozzle bar
31 Housing
31*a* Hollow space
31*b* Profile wall, housing wall
31*c* Neck
31*d* Rail
31*e* Rail
32 Pivot bearing
33 Opening
34 Eccentric
35 Normal direction
36 Direction of the blast air current
37 Direction of the blast air current
38 Blast air openings
39 Nozzle plate
40 Nozzle openings
41 Blast nozzles
42; 42*a* to 42*n* Nozzle inserts
42' Nozzle duct
42" Outlet of nozzle duct
43; 43*a* to 43*n* Valve, magnetic valve
43'; 443" Air inlet openings
44; 44*a* to 44*n* Magnetic valve control
45; 45*a* to 45*n* Bores
46; 46*a* to 46*n* Bores
47 Duct
48*a*, 48*b* Closure plates
49 Screw
50 Opening (bore)
51 Compressed air connection line
52 Foreign particle
53 Electronic control and regulating device
54 Image evaluating device
55 Image evaluation
56 Channel Although the foregoing invention has been described in detail by way of illustration and example for purposes of understanding, it will be obvious that changes and modifications may be practised within the scope of the appended claims.

What we claim is:

1. An apparatus in a spinning preparation installation, comprising:

conveying equipment for conveying fibre material; and an arrangement for separating foreign objects from said fibre material, comprising:

a plurality of air nozzles adapted to be coupled to a source of compressed air and arranged across the width of the conveying equipment, wherein the air nozzles are adapted to direct a blast of air towards the fibre material to detach and remove the foreign objects from the conveyed fibre material, and a bar member into which the air nozzles are incorporated, wherein the bar member comprises a housing with wall elements and a hollow interior having a longitudinal axis, wherein the hollow interior of the housing comprises a compressed air duct adapted to supply air to the air nozzles, wherein the housing includes two rows of bores arranged on opposite sides of and parallel to the longitudinal axis of the housing, wherein bores of the first row are coaxially aligned with bores of the second row and each pair of coaxially aligned bores is adapted to receive one of the plurality of air nozzles, and wherein the air nozzles pass through the hollow interior and at least one wall element of the housing.

2. The apparatus according to claim 1, wherein the air nozzles include valves to connect to the source of compressed air.

3. The apparatus according to claim 1, wherein the air nozzles are coupleable to the source of compressed air through the hollow interior of the housing.

4. The apparatus according to claim 1, wherein the two rows of bores present through holes for receiving the air nozzles.

5. The apparatus according to claim 1, further comprising a nozzle plate, including plurality of nozzle openings, that is adapted to be coupled to the bar member, wherein the plurality of nozzle openings is greater than the number of bores in one of the two rows of bores.

6. The apparatus according to claim 1, wherein the bar member with the air nozzles is rotatable or pivotable about a pivot point or axis.

7. The apparatus according to claim 6, further comprising a drive coupled to the arrangement which is adapted to effect rotary or pivoting movement.

8. The apparatus according to claim 1, further comprising an optical sensor system arranged upstream of the arrangement.

9. The apparatus according to claim 8, further comprising an electronic control and regulating device adapted to couple the optical sensor system to the downstream arrangement for the separation of the foreign objects.

10. The apparatus according to claim 8, wherein the air nozzles are activatable at locations across the width of the conveying equipment corresponding to those upstream locations at which the sensor system has detected foreign objects.

11. The apparatus according to claim 1, wherein a momentary blast air current is activatable.

12. The apparatus according to claim 1, wherein the outlets of the air nozzles are at least one of locally displaceable, simultaneously displaceable, or uniformly displaceable.

13. The apparatus according to claim 1, wherein the conveying equipment comprises a pneumatic conveyor duct and the longitudinal axis of the bar member extends substantially transversely to the axis of the pneumatic transport duct, the air nozzles being adapted to direct the blast of air substantially perpendicularly to or obliquely to the axis of the pneumatic transport duct.

14. The apparatus according to claim 13, further comprising an optical sensor system associated with the pneumatic transport duct for the detection of foreign objects of polypropylene in or between fibre tufts.

15. An apparatus in a spinning preparation installation, comprising:

conveying equipment for conveying fibre material; and an arrangement for separating foreign objects from said fibre material, comprising:

a plurality of air nozzles adapted to be coupled to a source of compressed air and arranged across the width of the conveying equipment, wherein the air nozzles are adapted to direct a blast of air towards the fibre material to detach and remove the foreign objects from the conveyed fibre material, a bar member into which the air nozzles are incorporated, wherein the bar member comprises a housing with wall elements and a hollow interior having a longitudinal axis, wherein the housing includes two rows of bores arranged on opposite sides of and parallel to the longitudinal axis of the housing, wherein bores of the first row are coaxially aligned with bores of the second row and each pair of coaxially aligned bores is adapted to receive one of the plurality of air nozzles, and wherein the air nozzles pass through the hollow interior and at least one wall element of the housing, and valves coupled to the air nozzles, wherein the valves are arranged at least partially in the hollow interior of the housing, and valve control devices coupled to the valves, wherein the valve control devices are located outside the hollow interior.

16. An apparatus in a spinning preparation installation, comprising:

conveying equipment for conveying fibre material; and an arrangement for separating foreign objects from said fibre material, comprising:

a plurality of air nozzles adapted to be coupled to a source of compressed air and arranged across the width of the conveying equipment, wherein the air nozzles are adapted to direct a blast of air towards the fibre material to detach and remove the foreign objects from the conveyed fibre material, a bar member into which the air nozzles are incorporated, wherein the bar member comprises a housing with wall elements and a hollow interior having a longitudinal axis, wherein the housing includes two rows of bores arranged on opposite sides of and parallel to the longitudinal axis of the housing, wherein bores of the first row are coaxially aligned with bores of the second row and each pair of coaxially aligned bores is adapted to receive one of the plurality of air nozzles, and wherein the air nozzles pass through the hollow interior and at least one wall element of the housing, and nozzle inserts coupled to the housing and adapted to receive the air nozzles, wherein the nozzle inserts include air inlet openings that are arranged within the hollow interior of the housing.

17. An apparatus in a spinning preparation installation, comprising:

conveying equipment for conveying fibre material; and an arrangement for separating foreign objects from said fibre material, comprising:

a plurality of air nozzles adapted to be coupled to a source of compressed air and arranged across the width of the conveying equipment, wherein the air nozzles are adapted to direct a blast of air towards the fibre material to detach and remove the foreign objects from the conveyed fibre material, and a bar member into which the air nozzles are incorporated, wherein the bar member comprises a housing with wall elements and a hollow interior having a longitudinal axis, wherein the housing includes two rows of bores arranged on opposite sides of and parallel to the longitudinal axis of the housing, wherein bores of the first row are coaxially aligned with bores of the second row and each pair of coaxially aligned bores is adapted to receive one of the plurality of air nozzles, and wherein the air nozzles pass through the hollow interior and at least one wall element of the housing, wherein the conveying equipment is a roller for opening or doffing fibre material and the bar member is associated with the roller.

18. The apparatus according to claim 17, wherein the effective direction of the blast of air is adjustable in relation to the roller.

19. The apparatus according to claim 17, wherein the bar member with the air nozzles is radially and/or axially displaceable in relation to the roller.

20. The apparatus according to claim 17, further comprising an optical sensor system associated with the roller for the detection of foreign objects.

* * * * *